US007159250B2

(12) United States Patent
Chiang

(10) Patent No.: US 7,159,250 B2
(45) Date of Patent: Jan. 9, 2007

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 112 days.

(21) Appl. No.: 10/852,232

(22) Filed: May 25, 2004

(65) Prior Publication Data

US 2005/0273915 A1 Dec. 15, 2005

(51) Int. Cl.
*A61F 9/02* (2006.01)

(52) U.S. Cl. ..... 2/428; 2/426; 2/427; 2/429; 2/430; 2/431; 2/432; 2/435; 2/439; 2/440; 2/441; 2/442; 2/443; 2/444; 2/445; 2/450; 2/452

(58) Field of Classification Search ..... 2/426, 2/427, 431, 435, 440, 443, 445, 444, 428, 2/429, 430, 432, 433, 439, 441, 442, 450, 2/452

See application file for complete search history.

(56) References Cited

U.S. PATENT DOCUMENTS 5,524,300 A * 6/1996 Chiang ..... 2/439
5,802,621 A * 9/1998 Chou ..... 2/430
5,884,339 A * 3/1999 Fukasawa ..... 2/446
5,896,588 A * 4/1999 Chiang ..... 2/428
5,901,382 A * 5/1999 Chiang ..... 2/445
5,950,248 A * 9/1999 Kawashima et al. ..... 2/441
6,023,791 A * 2/2000 Chiang ..... 2/441

* cited by examiner

*Primary Examiner*—Gary L. Welch
*Assistant Examiner*—Alissa J. Tompkins
(74) *Attorney, Agent, or Firm*—Troxell Law Office, PLLC

(57) ABSTRACT

A pair of swimming goggles includes left and right frames made of hard material, a head strap and a connection frame connecting the left and right frames and made of soft material. Supporters respectively extend from the inner ends of the peripheral surfaces of the frames opposite to the fastener base. A fill zone is defined in each of the inner surfaces of the frames opposite the supporters. A head strap is connected to the fastener base of each of the left and right frames. The connection frame includes a nose bridge and left and right pads connecting with opposite ends of the nose bridge. Receiving recesses are respectively defined in the junctions between the nose bridge and the pads for respectively receiving the supporters therein. Junction portions are respectively formed at the left and right pads corresponding to the fill zone of each of the left and right frames for being filled in the fill zone.

4 Claims, 5 Drawing Sheets

SWIMMING GOGGLES

BACKGROUND OF THE INVENTION

1. Field of the Invention

The present invention relates to a pair of swimming goggles, and particularly to swimming goggles of which a nose bridge and pads are made of soft material and integrally formed with frames made of hard material, and which provides a good support at the nose bridge thereof, provides comfortable contact to a wearer and prevents the frames from deformation.

2. Related Art

A pair of conventional swimming goggles has a pair of frames, a nose bridge and a pair of pads integrally formed together. As shown in FIG. 1, Taiwan utility model patent No. 83200405 (represented as Patent '405 for following description) granted to the present applicant relates to a pair of integrated type swimming goggles. The swimming goggles disclosed by Patent '405 and integrally including the lens frames, the bridge member, and the gaskets shall provide the soft material to the gasket adjacent to a user's face thereby providing a comfortable wearing. A portion on the lens frame for passing therethrought by the head strap shall withstand the pulling strength thereby avoiding the deformation of the lens frame. Therefore, the structure feature of Patent '405 discloses a pair of swimming goggles 70 integratedly molded from a soft material and including a pair of lens frames, 71, 72, a bridge member 73, and a pair of gaskets 74, which are all made from the soft material. In order to avoid the deformation of the lens frames 71, 72 when wearing, the cross-section of the bridge member 73 is arcuated, and the center portion thereof is comparatively think and the lateral portion thereof is comparatively thin. The lateral portions of the lens frames 71, 72 form a pair of stop members 75 such that the pressing end 77 of the head strap 76 is stopped by the stop member. Therefore, when the head strap 76 is pulled for wearing the goggles, the pulling strength shall be spread over the stop member 75 and the comparatively thick central portion of the bridge member 73 thereby avoiding the deformation of the lens frames 71, 72.

Moreover, the nose bridge of the swimming goggles is made of soft material and fixed between the inner ends of left and right frames, which provides a poor support at the nose bridge. Additionally, a wearer with a big bridge of his nose may feel uncomfortable since the width of the nose bridge is at a given range and should be pressed the nose bridge.

SUMMARY OF THE INVENTION

Accordingly, an object of the present invention is to provide a pair of swimming goggles which provides a good support at the nose bridge thereof, provides comfortable contact to a wearer and prevents frames thereof from deformation.

Further object of the present invention is to provide a pair of swimming goggles which is light and handy, reduces resistance thereof when used in water and widens visual field of a wearer.

To achieve the above-mentioned objects, a pair of swimming goggles in accordance with the present invention includes left and right frames made of hard material, a head strap and a connection frame connecting the left and right frames and made of soft material. Each of the left and right frames has an inner surface, an outer surface and a peripheral surface between the inner surface and the outer surface.

A lens is formed with each of the outer surfaces of the frames. A fastener base is formed at the outer end of each of the peripheral surfaces. Supporters respectively extend from the inner ends of the peripheral surfaces of the frames opposite to the fastener base. A fill zone is defined in each of the inner surfaces of the frames opposite the supporters. A head strap is connected to the fastener base of each of the left and right frames. The connection frame includes a nose bridge and left and right pads connecting with opposite ends of the nose bridge. Receiving recesses are respectively defined in the junctions between the nose bridge and the pads for respectively receiving the supporters therein. Junction portions are respectively formed at the left and right pads corresponding to the fill zone of each of the left and right frames for being filled in the fill zone.

Other objects, advantages and novel features of the present invention will be drawn from the following detailed embodiment of the present invention with attached drawings, in which:

DESCRIPTION OF THE PREFERRED EMBODIMENT

Figure 1:
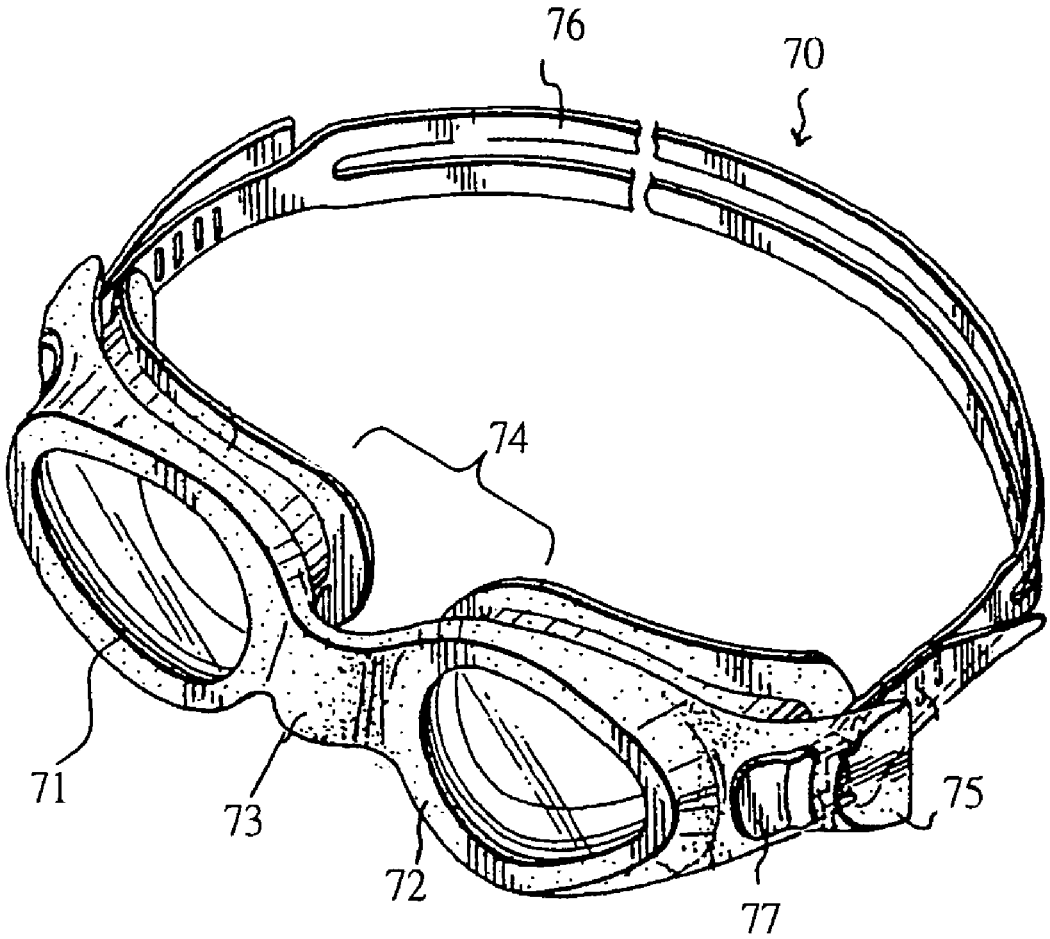
FIG .1 PRIOR ART
FIG. 1 is a perspective view of conventional swimming goggles.
Figure 2:
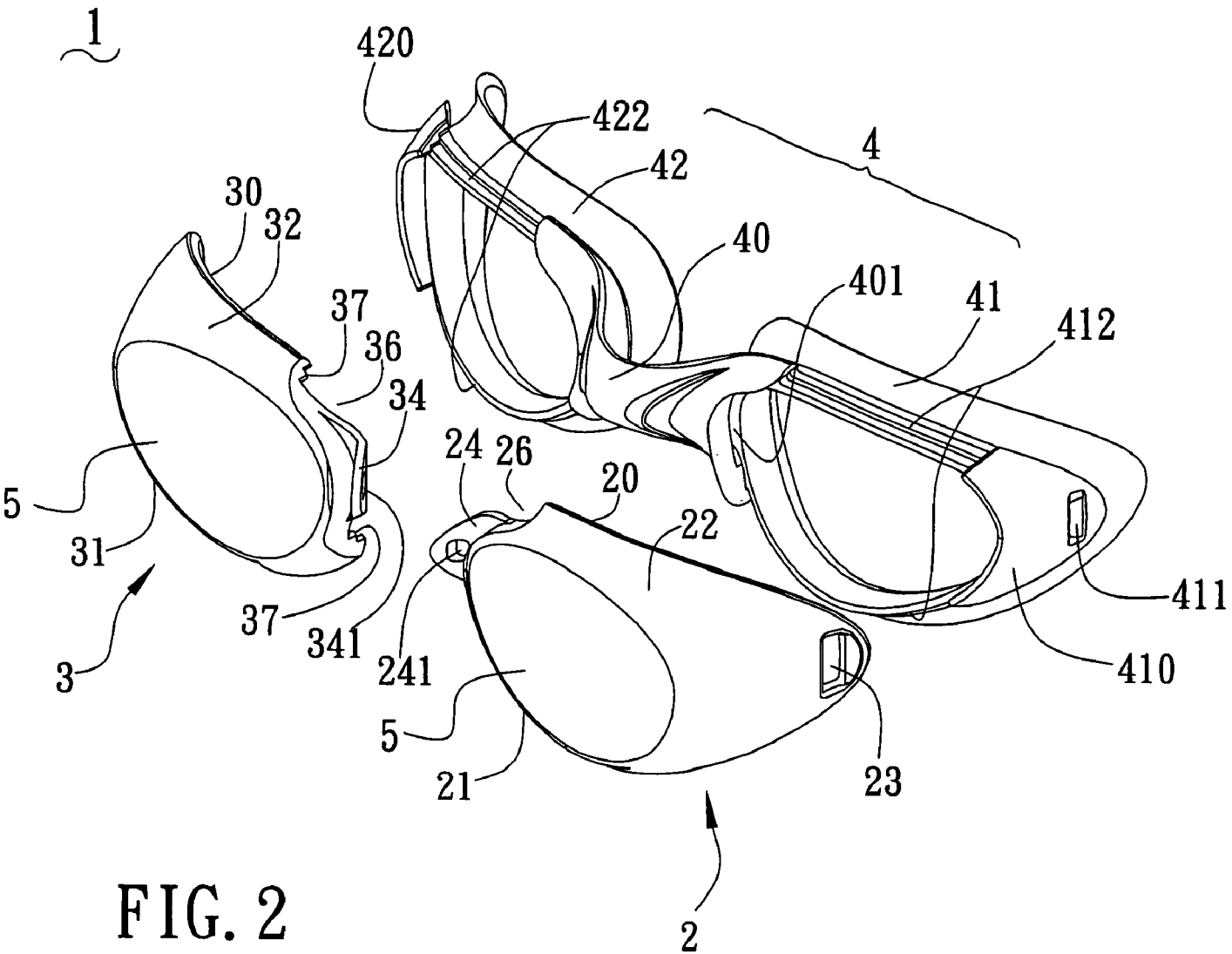
FIG. 2 is an exploded view of a pair of swimming goggles of the present invention.
Figure 5:
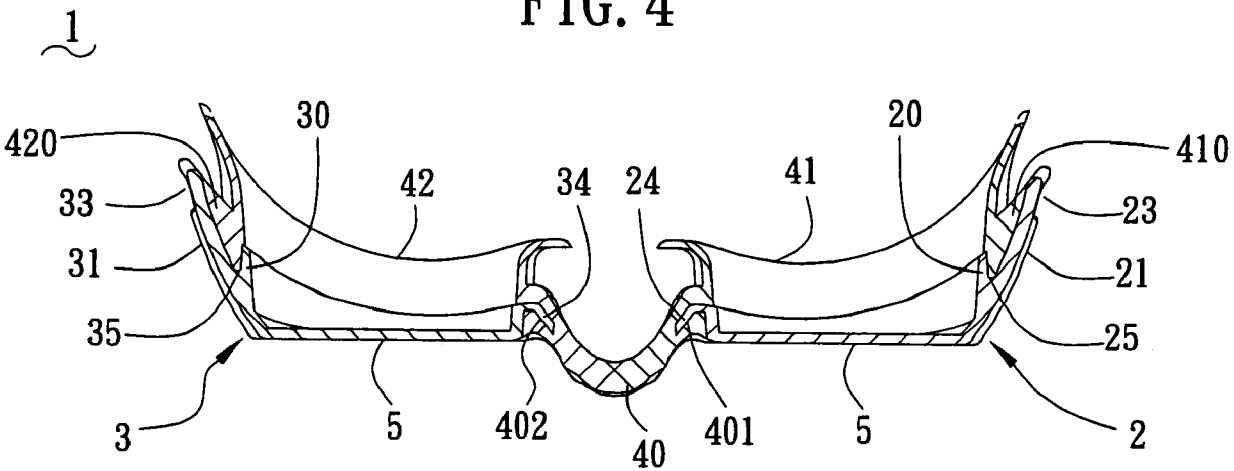
FIG. 5 is a cross-sectional view taken along line 5—5 in FIG. 4.
Figure 6:
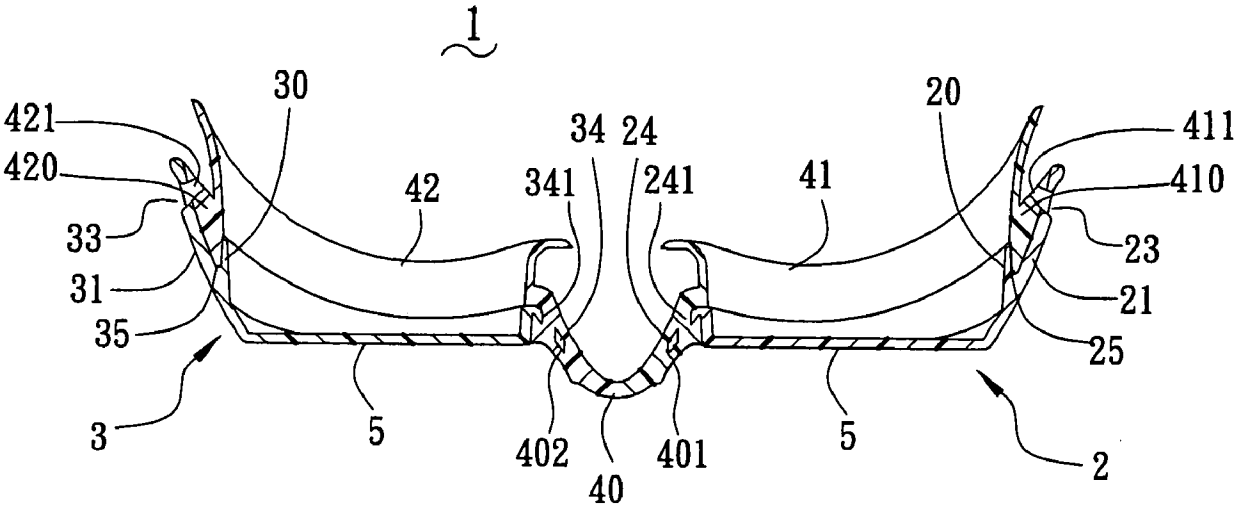
FIG. 6 is a cross-sectional view taken along line 6—6 in FIG. 4.
Figure 8:
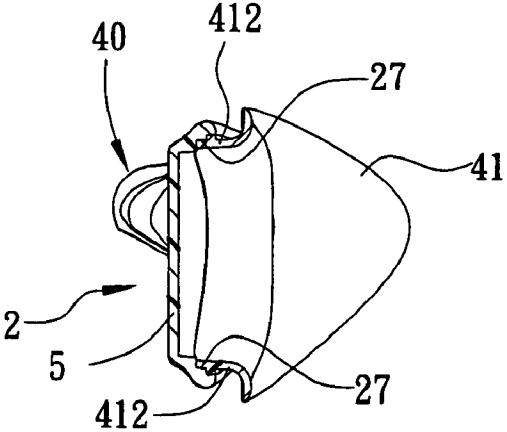
FIG. 8 is a cross-sectional view taken along line 8—8 in FIG. 4.

Referring to FIG. 2, a pair of swimming goggles 1 of the present invention includes a left lens frame 2, a right lens frame 3, a connection frame 4, and a head strap (not shown). Each of the left and right frames 2, 3 is made of hard material and has an inner surface 20, 30, an outer surface 21, 31 and a peripheral surface 22, 32 between the inner surface 20, 30 and the outer surface 21, 31. A lens 5 is integrally formed with the outer edge of each of the outer surfaces 21, 31 of the frames 2, 3 thereby reducing resistance of the swimming goggles 1 used in water and widening visual field of a wearer. A fastener base is formed at the outer end of each of the peripheral surfaces 22, 32. In this embodiment, the fastener base is a connection hole 23, 33 (see FIGS. 5–6) for extension of the head strap. Supporters 24, 34 respectively extend from the inner surfaces 20, 30 of the frames 2, 3 at the inner ends of the peripheral surfaces 22, 32 opposite to the connection holes 23, 33. Through holes 241, 341 are respectively defined in the supporters 24, 34 for connecting with the connection frame 4. Also referring to FIGS. 5–6, a fill zone is defined in each of the inner surfaces 20, 30 of the frames 2, 3 opposite the supporters 24, 34. The fill zone includes the inner surfaces 20, 30, the outer surfaces 21, 31 and grooves 25, 35 defined between the inner surfaces 20, 30 and the outer surfaces 21, 31 for being filled with junction portions 410, 420 of the connection frame 4. Openings 26, 36 are respectively defined in the peripheral surfaces 22, 32 of the frames 2, 3 adjacent to the supporters 24, 34 for increasing area of the supporters 24, 34 to be received in the connection frame 4. Referring to FIGS. 2 and 8, roughness surfaces 27, 37 are respectively formed at inner sides of upper and lower flanges of the peripheral surfaces 22, 32 of the frames 2, 3 between the openings 26, 36 and the fill zones for enhancing the connection frame 4 to connect with the frames 2, 3.

The connection frame 4 connects the left and right frames 2, 3 together and is made of soft material. The connection frame 4 includes a nose bridge 40 and left and right pads 41, 42 connecting with opposite ends of the nose bridge 40. Also referring to FIGS. 5–6, receiving recesses 401, 402 are respectively defined in the junctions between the nose bridge 40 and the pads 41, 42 for respectively receiving the supporters 24, 34 therein in an integral molding process. The junction portions 410, 420 are respectively formed at the left and right pads 41, 42 corresponding to the fill zones of the left and right frames 2, 3 for being filled in the fill zones in the integral molding process. Through holes 411, 421 are respectively defined in the junction portions 410, 420 corresponding to the connection holes 23, 33 of the frames 2, 3 for extension of the head strap. Referring to FIGS. 2 and 8, connection portions 412, 422 are respectively formed at upper and lower flanges of the pads 41, 42 between the receiving recesses 401, 402 and junction portions 410, 420 for connecting with the roughness surfaces 27, 37 of the frames 2, 3.

Figure 3:
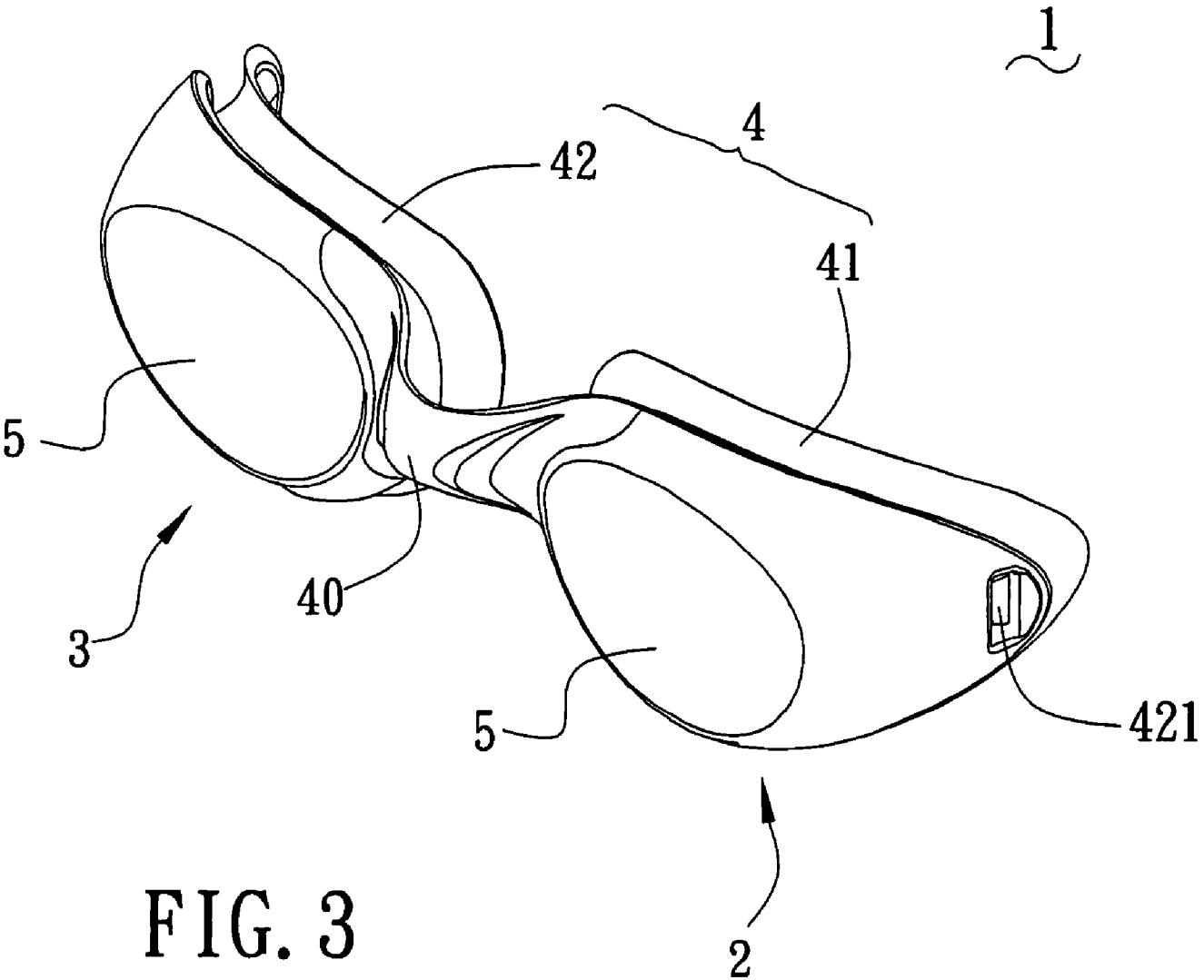
FIG. 3 is an assembled view of FIG. 2.
Figure 4:
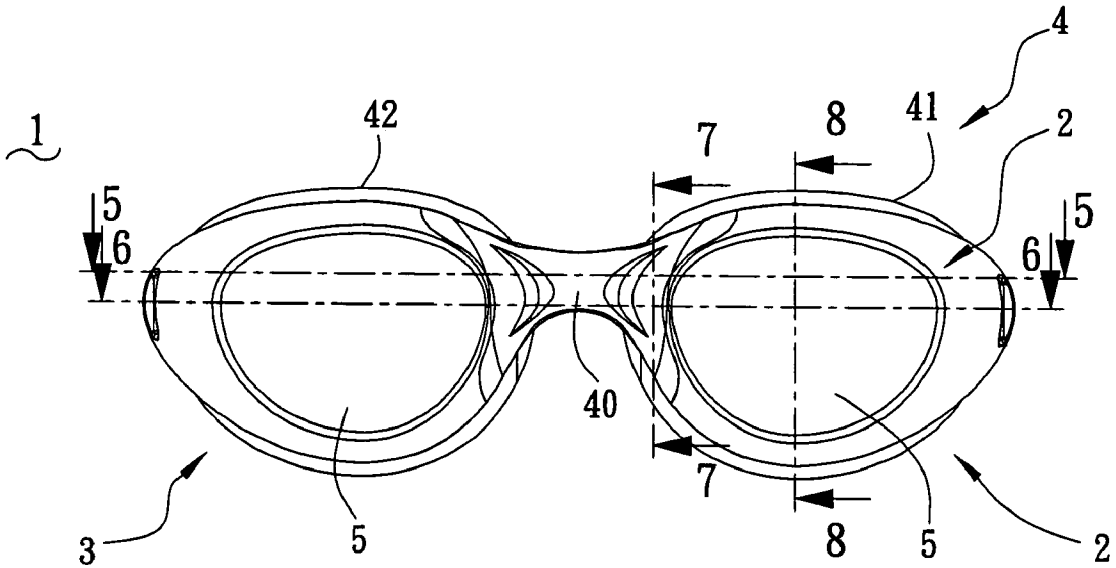
FIG. 4 is a front elevational view of FIG. 3.
Figure 7:
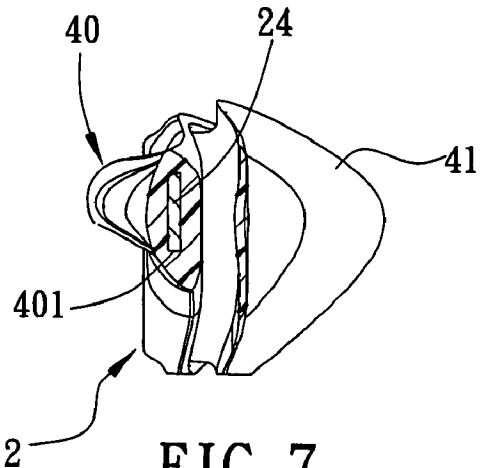
FIG. 7 is a cross-sectional view taken along line 7—7 in FIG. 4.

Referring to FIGS. 3–4, in the integral molding process, the connection frame 4 connects with the left and right frames 2, 3. The lenses 5 are integrally formed with the left and right frames 2, 3. Therefore, the swimming goggles 1 of the present invention is light and handy. Further referring to FIG. 7 showing a cross-sectional view of the left lens frame 2, the supporter 24 is received in the receiving recess 401 in the integral molding process whereby the inner end of the left lens frame 2 is effectively connected with the connection frame 4. Further referring to FIG. 8, the upper and lower flanges of the left lens frame 2 is effectively connected with the connection frame 4 through the roughness surfaces 27 of the left lens frame 2 connecting with the connection portions 412 of the connection frame 4. Further referring to FIG. 6, the outer end of the left lens frame 2 is effectively connected with the connection frame 4 through the fill zone receiving the junction portion 410, 420 of the left and right pads 41, 42. Thus, in the integral molding process, the soft material of the nose bridge 40 and the pads 41, 42 integrally connects with the hard material of the frames 2, 3. The head strap is fixed to opposite sides of the hard material of the frames 2, 3. The soft material of the pads 41, 42 may comfortably contact the face of the wearer. The nose bridge 40 of the connection frame 4 provides a good support through the supporters 24, 34. Therefore, the swimming goggles 1 of the present invention provides a good support at the nose bridge, provides comfortable contact to a wearer and prevents the frames from deformation.

It is understood that the invention may be embodied in other forms without departing from the spirit thereof. Thus, the present example and embodiment are to be considered in all respects as illustrative and not restrictive, and the invention is not to be limited to the details given herein.

The invention claimed is:

1. A pair of swimming goggles, comprising:

left and right frames being made of hard material, each of the left and right frames having an inner surface, an outer surface and a peripheral surface between the inner surface and the outer surface, a lens being formed with each of the outer surfaces of the left and right frames, a fastener base being formed at the outer end of each of the peripheral surfaces, supporters respectively extending from the inner ends of the peripheral surfaces of the frames opposite to the fastener base, a fill zone being defined in each of the inner surfaces of the frames opposite the supporters;

a head strap connecting with the fastener base of each of the left and right frames; and a connection frame connecting the left and right frames and being made of soft material, the connection frame comprising a nose bridge and left and right pad connecting with opposite ends of the nose bridge, receiving recesses being respectively defined in the junctions between the nose bridge and the pads for respectively receiving the supporters therein, junction portions being respectively formed on the left and right pads, one of the junction portions is inserted in the fill zone of each of the left and right frames, wherein openings are respectively defined in the peripheral surfaces of the left and right frames adjacent to the supporters for increasing area of the supporters to be received in the connection frame, further comprising roughness surfaces respectively formed at inner sides of upper and lower flanges of the peripheral surfaces of the left and right frames between the openings and the fill zones enhancing a connection between the connection frame and the left and right frames, wherein connection portions are respectively formed on upper and lower flanges of the connection frame between the receiving recesses and the junction portions and connected with the roughness surfaces of the left and right frames, wherein the fastener base of each of the left and right frames has a connection hole located on the peripheral surfaces thereof, each of the junction portions of the connection frame has a junction portion through hole, one junction portion through hole aligning with each connection hole, the head strap extending through each junction portion through hole and each connection hole.

2. The swimming goggles as claimed in claim 1, wherein the supporters respectively extend from the inner surfaces of the left and right frames, and through holes are respectively defined in the supporters.

3. The swimming goggles as claimed in claim 2, wherein the fill zone includes the inner surfaces, the outer surfaces and grooves defined between the inner surfaces and the outer surfaces.

4. The swimming goggles as claimed in claim 1, wherein the lens is integrally formed with the outer edge of each of the outer surfaces of the left and right frames.

* * * * *